US006195809B1

(12) United States Patent
Garcia

(10) Patent No.: US 6,195,809 B1
(45) Date of Patent: Mar. 6, 2001

(54) HIP-PAD FOR PROTECTION OF GREATER TROCHANTER

(75) Inventor: Mario C. Garcia, West St. Paul, MN (US)

(73) Assignee: Prevent Products, Inc., West St. Paul, MN (US)

( * ) Notice: Subject to any disclaimer, the term of this patent is extended or adjusted under 35 U.S.C. 154(b) by 0 days.

(21) Appl. No.: 09/459,681

(22) Filed: Dec. 13, 1999

(51) Int. Cl.[7] ..... A41D 13/00
(52) U.S. Cl. ..... 2/455; 2/455; 2/465; 2/267
(58) Field of Search ..... 2/228, 238, 227, 2/69, 455, 465, 267, 23, 24; 602/61, 62

(56) References Cited

U.S. PATENT DOCUMENTS

| | | | |
|---|---|---|---|
| 835,219 | | 11/1906 | Flick . |
| 1,088,273 | | 2/1914 | Golden . |
| 1,527,009 | | 2/1925 | Plate . |
| 2,889,830 | | 6/1959 | Raymond . |
| 3,772,704 | | 11/1973 | Carbonneau . |
| 3,909,847 | | 10/1975 | Holt et al. . |
| 4,177,806 | | 12/1979 | Griffin . |
| 4,272,850 | | 6/1981 | Rule . |
| 4,479,269 | | 10/1984 | Balliet . |
| 4,486,901 | * | 12/1984 | Donzis ..... 2/455 |
| 4,573,216 | | 3/1986 | Wortberg . |
| 4,641,641 | | 2/1987 | Strock . |
| 4,748,975 | | 6/1988 | Yashima . |
| 4,807,301 | | 2/1989 | Ferber . |
| 5,014,354 | | 5/1991 | Dumont . |
| 5,020,547 | | 6/1991 | Strock . |
| 5,105,473 | | 4/1992 | Valtakari . |
| 5,134,726 | | 8/1992 | Ross . |
| 5,220,691 | | 6/1993 | Wiegers . |
| 5,309,570 | | 5/1994 | Grimm . |
| 5,410,756 | | 5/1995 | Hutson . |
| 5,717,997 | | 2/1998 | Garcia . |
| 5,722,093 | | 3/1998 | Andresen . |
| 5,779,658 | | 7/1998 | Saca . |
| 5,781,935 | | 7/1998 | Bassett et al. . |
| 5,790,981 | | 8/1998 | Bzoch . |

FOREIGN PATENT DOCUMENTS

| | | | | |
|---|---|---|---|---|
| 2136675 | * | 9/1984 | (GB) | 2/465 |
| WO 90/03126 | * | 6/1994 | (WO) | 2/465 |
| WO 94/12066 | * | 6/1994 | (WO) | 2/465 |

OTHER PUBLICATIONS

Robb III, "Hip Fracture Disease: Coping with a Contemporary Epidemic", *The Journal of Musculoskeletal Medicine*, Dec. 1993, pp. 12–16.

Wallace et al., "Iowa FISCSIT Trial: The Feasibility of Elderly Wearing A Hip Joint Protective Garment to Reduce Hip Fractures", *J. Am. Geriatr. Soc.*, 41, Mar. 1993, No. 3, pp. 338–340.

* cited by examiner

*Primary Examiner*—John J. Calvert
*Assistant Examiner*—Tejash Patel
(74) *Attorney, Agent, or Firm*—Haugen Law Firm PLLP

(57) ABSTRACT

A garment and insert combination for decreasing the risk of trauma to the hip joint in the greater trochanter region of the human body, and comprising a garment that fits over the hips and having a pocket to securely hold in place a generally planar but configured resilient hip pad. The pad is in the form of an annulus of generally inverted "U" configuration with the outer edges being coincidental with the outer periphery of the elliptical form, and with the annulus being open in the area covering the greater trochanter region.

3 Claims, 3 Drawing Sheets

HIP-PAD FOR PROTECTION OF GREATER TROCHANTER

BACKGROUND OF THE INVENTION

I. Field of the Invention

The present invention is an improvement over that disclosed in my U.S. Pat. No. 5,717,997 dated Feb. 17, 1998 and assigned to the same assignee as the present invention. This invention relates generally to a garment with an improved protective pad for protecting the hip joint area of the wearer from injury due to falls. More particularly, it relates to an improved force dissipating energy absorbent hip pad particularly for use by geriatric patients and offering protection of the greater trochanter from a variety of impacts which ultimately creates fractures in the patient. In particular, the present invention provides protection of the greater trochanter from injury due to certain types of falls. It will be understood, of course, that the device of the present invention is not intended to eliminate the occurrence of falls, but, on the other hand, it is intended to either reduce or eliminate damage to the wearer which may otherwise be occasioned as a result of a fall.

II. Discussion of the Prior Art

At a time when health care costs are continuing to escalate, medical research continues to focus on preventative medicine. The study of geriatrics has revealed that elderly individuals have an increased risk of hip fractures and also risk death related to hip fracture disease. Included within the elderly group are members of several select groups who are at greater risk. Among some of these greater at-risk groups are: persons, particularly females, over age 50, persons with chronic medical conditions, persons with impaired acuity, persons with osteoporosis, and persons with bodies having low muscle/fat content. The most frequent cause of hip fractures results from a fall, including light falls, with these falls frequently involving impact or trauma to the greater trochanter.

In the past, various devices have been constructed to reduce the occurrence of hip injuries due to falls or related events. These devices include hip pads used by athletes while playing soccer, hockey, baseball and also by skiers. Devices have also been constructed to prevent or reduce damage from such an injury among the elderly. These devices often contain a recess in the pad wherein the recess must be aligned in position directly in line with the greater trochanter region. These pads have normally been taped or strapped in place causing slight discomfort to the elderly person. When strapped in place, the pads have a tendency to slip becoming misaligned with the greater trochanter. When slipped, the pads decrease the effectiveness of protecting the greater trochanter from fractures. Further, these devices are often difficult to place in position so as to directly surround the greater trochanter area. Skilled medical assistance may be required to properly position and secure such a pad to the hip. The hip pads of the present invention may be easily secured in place, and may be manufactured in a variety of sizes without significantly increasing the costs of manufacture.

SUMMARY OF THE INVENTION

It is accordingly a principal object of the present invention to provide a comfortable, self-centering and user-friendly garment with a hip pad for use in geriatric patients for protection of the greater trochanter from impact which frequently leads to hip fracture problems.

Another object of the present invention is to provide a self-fitting garment which retains the configured hip pad in place in the desired region adjacent the greater trochanter.

Yet, another object of the present invention is to provide a flexible, self-centering, energy-absorbent hip pad that dissipates and spreads an impact force away from the greater trochanter region.

A further object of the present invention is to provide an energy-absorbent hip pad that is easy to use and does not require skilled medical assistance to properly position the pad.

A still further object of the present invention is to provide an energy-absorbent hip pad with ventilation to allow the hip pad to dissipate absorbed body heat.

In accordance with the present invention, the foregoing objects and advantages are achieved by providing a form-fitting garment that contains a molded, flexible planar member (hip pad) of predetermined inverted "U" geometric shape or configuration, with a cross-slit extending through the thickness of the hip pad.

The hip pad may be constructed with an outer frame-like pad of inverted "U" configuration and surround a central opening, the pad allowing for a certain amount of shifting of the garment and pad without compromising the effectiveness of the pad, and without creating stress points in the pad directly over and/or surrounding the area of the greater trochanter. The garment may be worn underneath other clothing or may be fashioned to be worn as outer apparel. On each side of the garment is a preformed pocket for retaining the hip pad. The pocket may be made from the same material as the overall garment but must have a certain degree of resilience to hold the hip pad in the same relative position within the pocket while being worn.

The form-fitting garment allows the pads to be properly positioned without requiring adhesives or straps, thereby making the application of this protection comfortable to the user. Further, because the protection is within the garment and is self-positioning, the user may be slightly disoriented and yet be able to properly arrange the protective garment in place. The form-fitting garment may be proportioned in various sizes to accommodate various configurations of the human body while utilizing the same hip pad. Because of their configuration, the pads conform to the individual's body structure thereby creating a comfortable fit.

The form-fitting garment, with its properly positioned pockets, retains the hip pads in substantially the same relative position with respect to the hip. In this manner, the outer frame-like structure of each hip pad is positioned or centered over and surrounds the greater trochanter region. The central opening is preferably positioned over the apex of the greater trochanter. The outer frame-like pad redirects energy from an impact away from the area directly above the greater trochanter. In this manner, the hip pad aids in dissipation of the impact forces, and absorbs and redirects at least some of the energy from these forces away from the greater trochanter. Thus, by wearing the garment, some injury and some possible hip fractures are avoided.

When worn, the hip pad normally absorbs thermal heat generated and transmitted by the user's body. In the preferred embodiment, a central opening allows for ventilation. This allows the heat absorbed by the hip pad to be dissipated into the air.

DESCRIPTION OF THE DRAWINGS

The foregoing features and advantages of the present invention will be readily apparent to those skilled in the art from a review of the following detailed descriptions of the preferred embodiment in conjunction with the accompanying drawings in which.

DETAILED DESCRIPTION OF THE PREFERRED EMBODIMENT

Figure 1:
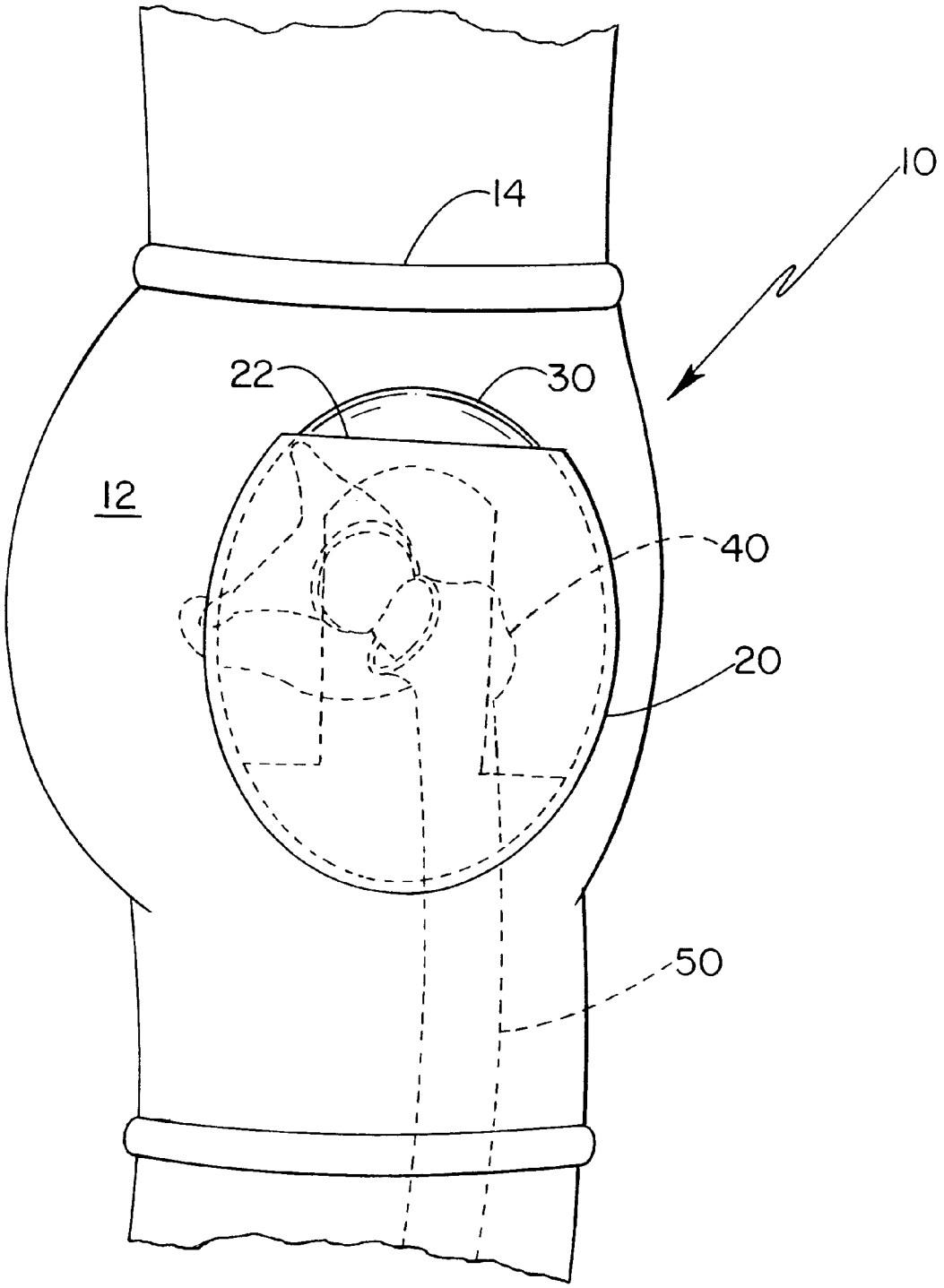
FIG. 1 is a side view of the form-fitting garment encompassing the human body and skeletal system with a sectioned-away pocket showing the improved hip pad.

Referring first to FIG. 1, there is indicated generally by numeral 10 a hip protector garment incorporating a preferred embodiment of the present invention. The hip protector garment 10 is made of a stretch fabric such as Spandex, one form of which is marketed as Lycra®, a trademark of E. I. DuPont de Nemours Co. of Wilmington, Del. Other form-fitting stretchable fabrics may be used. On each side 12 of the hip protector garment 10 is a pocket 20 designed to retain foam pad 30 proper when positioned and/or centered over the greater trochanter. The pockets 20 may be sewn on or otherwise securely attached to the sides. The pockets 20 have an opening 22 that allows insertion or removal of the hip pad 30. In the alternate preferred embodiment, the opening 22 is sewn shut or otherwise securely affixed to the hip protector garment sides 12. An elastic band 14 is preferably attached or sewn around the circumference of the top body-encircling opening. Of course, other means for securely holding the hip protector garment 10 above the user's waist may include a drawstring, belt, straps, or other means to securely hold the garment above the waist without deviating from the present invention.

Figure 2:
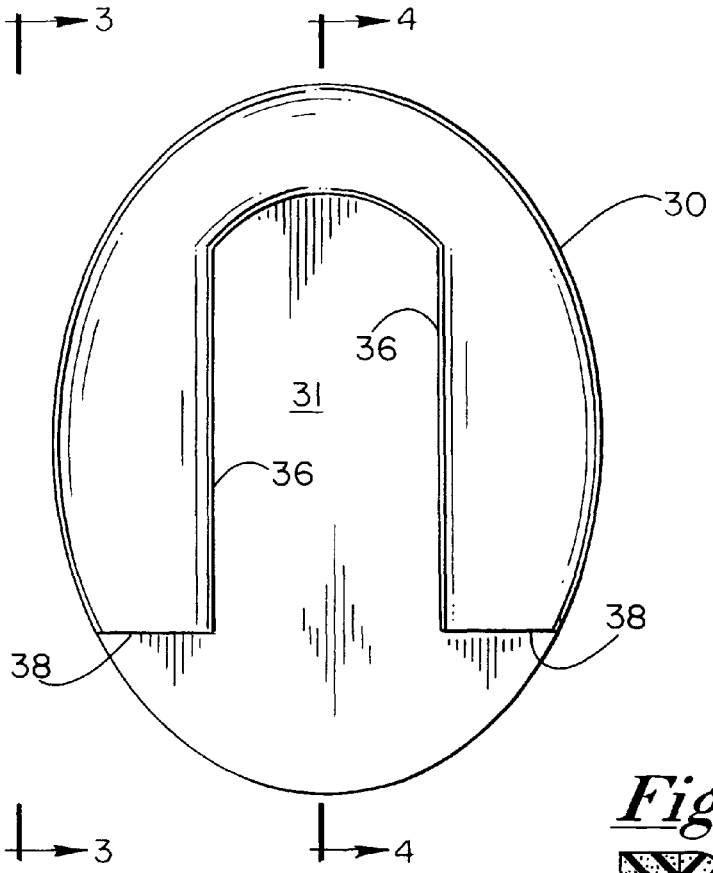
FIG. 2 is a front elevational view of the improved hip protector pad for the garment of the type shown in FIG. 1 and being shown on a slightly enlarged scale.
Figure 3:
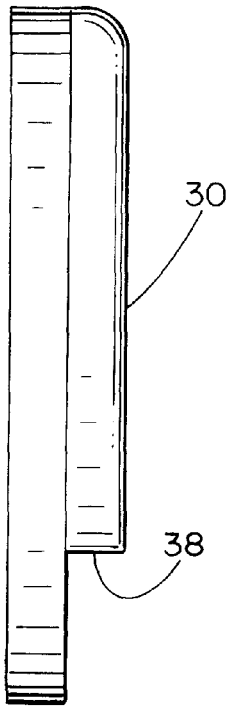
FIG. 3 is a side elevational view taken along the lines and in the direction of the arrows 3—3 of FIG. 2 of the improved hip pad.

Referring next to FIG. 2, the pockets are positioned on the garment so that when the hip protector garment is worn by human subject, the opening 31 of the central portion of the pad 30 is positioned with its apex aligned with the greater trochanter 40 of the human skeletal system 50 wearer. The center of the opening 31 is positionably centered above the apex of the greater trochanter 40. When a force is applied against the hip pad 30, the open center allows the area of the pad surrounding the greater trochanter region to compress more than the remaining area of the hip pad 30. This action, in turn, disperses the impact force against the pad away from the greater trochanter region. The energy from the forces against the pad are absorbed in the remaining region away from the greater trochanter area, thereby reducing fracture injuries of the greater trochanter region. In production, the pocket may be created in a number of various sizes, so that the pad 30 automatically aligns with varying body sizes and shapes.

The hip pad 30 is constructed from a resilient polymeric foam material known in the art for absorbing energy from impact forces. In the preferred embodiment, AFP #202, a closed-cell, crosslinked polyethylene, available from American Flexible Products of Chaska, Minn., is used. Other closed-cell foams may be used as well. The AFT #202 foam has the following properties:

| Property | Value |
|---|---|
| Density ASTM 3575½ inch | 2 pounds per cubic foot |
| Tensile strength-psi | 50 |
| Elongation percent | 180 |
| Tear strength - pounds per inch | 10.2 |
| Compression deflection - psi | 7.8 |
| Compression set percent | 12 |
| K factor | .247 |
| Working temp | −70 to 212° F. |
| Water absorption - psi | .01 |

Figure 4:
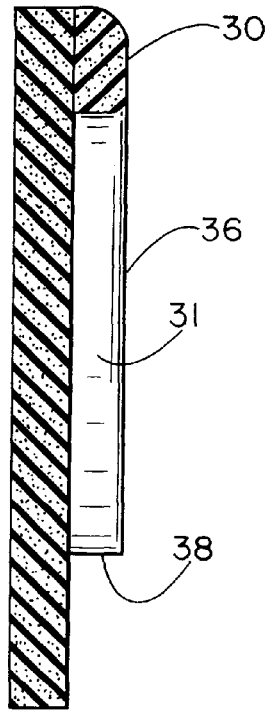
FIG. 4 is a vertical elevational view taken along the line and in the direction of the arrows 4—4 of FIG. 2.
Figure 5:
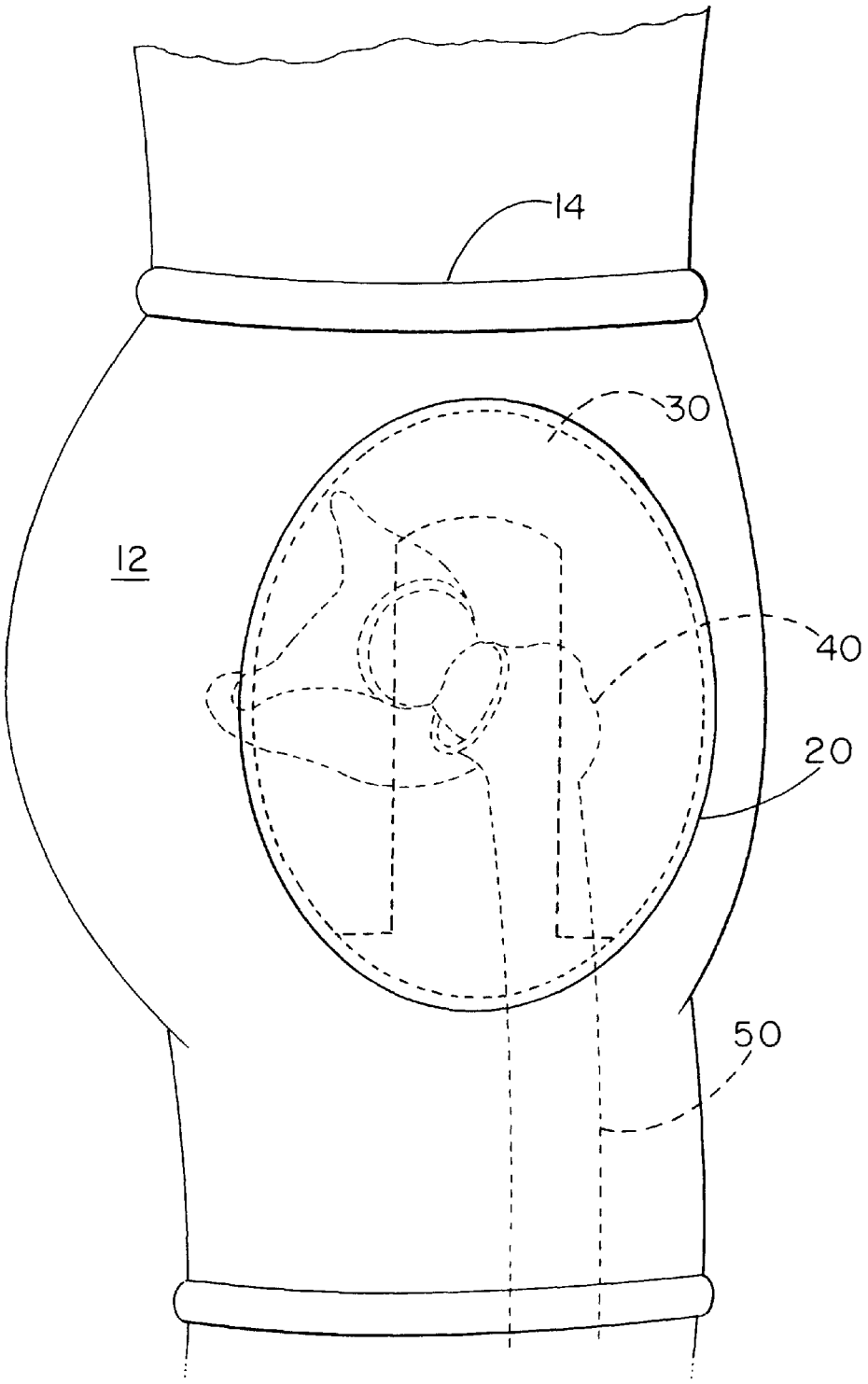
FIG. 5 is a side elevational view of an alternate preferred embodiment of the hip pad of the type shown in FIGS. 1–4.

Referring to FIGS. 4 and 5, the hip pad 30 having the above qualities is also of inverted "U" configuration, but of elongated rectangular form having long side edges 36 and opposed shorter side edges 38. The outer dimensions of the structure may, for example, be 6.5 inches by 8.5 inches with a thickness of one-half inch. Other sizes may be used while sufficiently protecting the greater trochanter region.

In the alternate preferred embodiment (see FIG. 5), somewhat wider legs and base components of the inverted "U" body may be employed, with FIG. 5 showing one such configuration. The legs and base provide a further means to position the opening in alignment with the apex of the greater trochanter and thereby disperse the energy away from the greater trochanter region. Also, the use of larger legs and base segments do not require the hip pad 30 to be as closely aligned with the center of the greater trochanter. Slight shifting of the garment will not affect the effectiveness of the hip pad 30. A plurality of aeration bores 42 may extend through the frame of hip pad 30. These aeration bores 42 may be arranged in various configurations, with FIG. 5 showing one such configuration. The aeration bores 42 dissipate some of the thermal energy transmitted to or absorbed by the hip pad 30 without affecting the absorption and dispersion of energy from an impact to the hip pad 30. The aeration bores 42 provide further flexibility of hip pad 30, increasing the comfort level of the user.

Having described the constructional features of the hip pad and garment for protecting the greater trochanter from impact, the mode of use will now be discussed. The garment and hip pad are primarily designed to be worn by the elderly who are at greater risk of hip fractures. The user may wear the protector garment underneath other clothing, or may be fashioned to be worn without outer garments. The hip pads are centered over the greater trochanter when placed in the pockets of the garment and the garment is then worn similar to a pair of shorts. The hip pads are flexible and form-fitting allowing the user to comfortably wear the hip protector garment 10. While being worn, the placement of the pockets 20 on the garment ensures that the mid-point of the opening in the pad will be positioned over the apex of the greater trochanter 40. The garment is form-fitting, keeping the hip pad 30 in relatively the same alignment.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different materials and methods and that various modifications both as to the materials and form can be accomplished without departing from the scope of the invention itself.

What is claimed is:

1. In combination with an apparatus for decreasing the risk or trauma to the hip joint and greater trochanter region and comprising a stretchable, elasticized garment that rests over the hips having a means to securely hold in place a generally planar hip pad, said garment including said generally planar hip pad having a generally elliptical first base portion with a raised portion superimposed thereon in the form of an open annulus being generally concentric with said first base portion, and with said open annulus including an outer ring of inverted "U" form comprising outer edges with a closed top and with an outer periphery, said outer edges being generally coincidental with said outer periphery of said elliptical first base portion and wherein said garment centrally aligns said open annulus over the greater trochanter region substantially at a geometric midpoint.

2. The combination as recited in claim 1 in which the cross-sectional thickness of said open annulus is substantially equal to the cross sectional thickness of said elliptical first base portion.

3. The combination as recited in claim 1 wherein said open annulus is bonded to said elliptical first base portion to form an impact-dissipating laminated structure.

* * * * *